US009901234B1

(12) United States Patent
Ebrahimi Afrouzi et al.

(10) Patent No.: US 9,901,234 B1
(45) Date of Patent: Feb. 27, 2018

(54) ROBOTIC VACUUM WITH ROTATING CLEANING APPARATUS

(71) Applicants: Ali Ebrahimi Afrouzi, San Jose, CA (US); Soroush Mehrnia, Copenhagen (DK); Azadeh Afshar Bakooshli, San Jose, CA (US)

(72) Inventors: Ali Ebrahimi Afrouzi, San Jose, CA (US); Soroush Mehrnia, Copenhagen (DK); Azadeh Afshar Bakooshli, San Jose, CA (US)

(73) Assignee: Bobsweep Inc., Toronto (CA)

( * ) Notice: Subject to any disclaimer, the term of this patent is extended or adjusted under 35 U.S.C. 154(b) by 137 days.

(21) Appl. No.: 14/922,143

(22) Filed: Oct. 24, 2015

Related U.S. Application Data

(60) Provisional application No. 62/068,579, filed on Oct. 24, 2014.

(51) Int. Cl.
*B08B 5/04* (2006.01)
*A47L 9/28* (2006.01)

(52) U.S. Cl.
CPC ..... *A47L 9/2831* (2013.01); *A47L 9/2852* (2013.01); *A47L 2201/04* (2013.01); *A47L 2201/06* (2013.01)

(58) Field of Classification Search
CPC .. A47L 9/2831; A47L 9/2852; A47L 2201/04; A47L 2201/06
See application file for complete search history.

(56) References Cited

U.S. PATENT DOCUMENTS 6,883,201 B2 * 4/2005 Jones ..... A47L 5/30 15/319
7,474,941 B2 * 1/2009 Kim ..... A47L 9/009 15/319
7,568,259 B2 * 8/2009 Yan ..... A47L 5/225 15/319
7,571,511 B2 * 8/2009 Jones ..... A47L 5/30 15/319
8,087,117 B2 * 1/2012 Kapoor ..... A47L 9/106 15/256.51
8,516,651 B2 * 8/2013 Jones ..... A47L 5/30 15/319
8,839,477 B2 * 9/2014 Schnittman ..... A47L 11/34 15/319
9,119,512 B2 * 9/2015 Martins, Jr. ..... A47L 5/14
2005/0166355 A1 * 8/2005 Tani ..... A47L 9/2805 15/319
2010/0313910 A1 * 12/2010 Lee ..... A47L 7/02 134/6
2010/0324734 A1 * 12/2010 Lee ..... A47L 11/33 700/258

(Continued)

*Primary Examiner* — Sharidan Carrillo

(57) ABSTRACT

A method for increasing the rate of debris collection of a robotic vacuum through increasing the number of times a robotic vacuum's cleaning apparatus passes over a work surface during each pass of the device. The device's main cleaning apparatus is installed on a plate that rotates within the housing of the device. The drive unit is housed separately from the rotating plate so that the device's normal movement patterns will be uninterrupted by the rotation of the cleaning apparatus. Ideally, the cleaning apparatus will be caused to rotate two or more times over an area before the robotic vacuum has driven completely through the area.

3 Claims, 2 Drawing Sheets

(56) References Cited

U.S. PATENT DOCUMENTS

| | | | | |
|---|---|---|---|---|
| 2014/0189977 | A1* | 7/2014 | Wang | A47L 9/009 15/347 |
| 2015/0223653 | A1* | 8/2015 | Kim | A47L 9/0411 15/384 |

* cited by examiner

ROBOTIC VACUUM WITH ROTATING CLEANING APPARATUS

CROSS-REFERENCE TO RELATED APPLICATIONS

This application claims the benefit of provisional patent application Ser. No. 62/068,579, filed Oct. 24, 2014 by the first named inventor.

FIELD OF INVENTION

The present invention relates to automatic floor cleaning systems.

BACKGROUND OF INVENTION

The following is a tabulation of some prior art that presently appears relevant:

U.S. Patent Documents

| U.S. Pat. No. | Kind Code | Issue Date | Patentee |
|---|---|---|---|
| 7,568,259 | B2 | Aug. 4, 2009 | Jason Yan |
| 9,119,512 | B2 | Sep. 1, 2015 | Martins Maintenance, Inc. |
| 8,839,477 | B2 | Sep. 23, 2014 | Irobot Corporation |
| 8,087,117 | B2 | Jan. 3, 2012 | Irobot Corporation |
| 7,571,511 | B2 | Aug. 11, 2009 | Irobot Corporation |
| 8,516,651 | B2 | Aug. 27, 2013 | Irobot Corporation |
| 6,883,201 | B2 | Apr. 26, 2005 | Irobot Corporation |
| 7,474,941 | B2 | Jul. 24, 2003 | Samsung Gwangju Electronics Co., Ltd. |

Robotic vacuums have becoming increasingly popular to clean floors in modern homes. However, robotic vacuums frequently do not collect all of the debris on a work surface in a single pass. Several solutions to increase the efficiency of these devices have been attempted. Robotic vacuums have been equipped with different mechanisms, such as more dense brushes and more powerful vacuuming motors to reduce the possibility of leaving behind debris. Another solution is to use more intensive movement patterns that cause the device to cover areas more than once, however this solution increases the length of time required to adequately service an area.

A need exists for a method to increase the rate of debris collection of a robotic vacuum cleaner that does not increase the length of time to clean an area. A need exists for a solution that may be combined with other methods of increasing cleaning power.

SUMMARY OF INVENTION

It is a goal of the present invention to increase the rate of debris collection of a robotic vacuum cleaner.

It is a goal of the present invention to increase the efficiency of a robotic vacuum cleaner.

It is a goal of the present invention to provide a solution that can be combined with other methods to further increase cleaning efficiency.

The present invention achieves the aforementioned goals through a robotic vacuum design in which the cleaning apparatuses are housed on an independently rotating plate within the device. The plate rotates in a plane parallel to the plane of the work surface as the device drives through the work area. The rotating cleaning apparatus causes the vacuuming elements to pass multiple times over areas that the vacuum traverses as it is moving.

DETAILED DESCRIPTION OF THE INVENTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Various embodiments are described below, including methods and techniques. The disclosure described herein is directed generally to a robotic vacuum with a rotating cleaning apparatus.

As understood herein, the term "robotic vacuum" may be defined generally to include one or more autonomous devices having communication, mobility, vacuuming and/or processing elements. For example, a robotic vacuum may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., one or more clock or synchronizing devices, a vacuum motor to provide suction, a debris dustbin to store debris, a brush to facilitate collection of debris, and a means to spin the brush.

Generally, a robotic vacuum with two sections, one of which spins in a plane parallel to the plane of the work surface, is proposed. The inner section houses the cleaning apparatuses, vacuum motor, and debris container. The outer section supports the inner section and houses all the other robotic vacuum components as well as a means to rotate the inner section within the outer section. The rotating action allows the cleaning apparatuses to pass multiple times over the portion of the work surface that the vacuum is traveling over as it moves. This increase in coverage results in a more thoroughly cleaned area.

Figure 1:
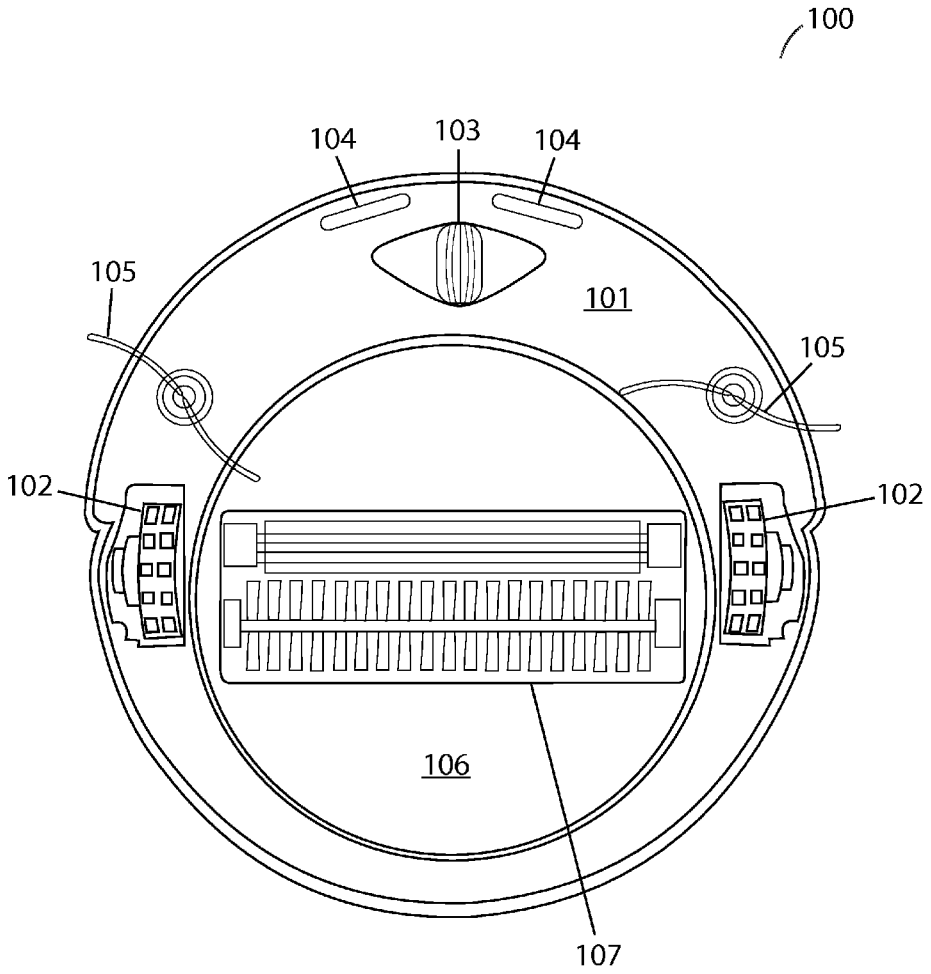
FIG. 1 illustrates is an overhead view of the underside of a robotic vacuum with a rotating cleaning assembly embodying features of the present invention.

Referring to FIG. 1, an overhead view of the underside of a robotic vacuum 100 with a rotatable cleaning apparatus is illustrated. An outer section 101 of the robotic vacuum houses all the stationary components, including driving wheels 102, steering wheel 103, a control system (not shown), batteries (not shown), and a means to rotate the inner section (not shown). The outer section may further house other components without limitation. The robotic vacuum components shown are included for illustrative purposes only and are not intended to limit the invention to the particular design shown. In the example shown, the outer section further houses sensors 104 and side brushes 105. An inner section 106 of the robotic vacuum is supported by and rotates within the outer section. The inner section houses the main cleaning apparatuses 107, vacuum motor (not shown), and debris container (not shown).

Figure 2A:
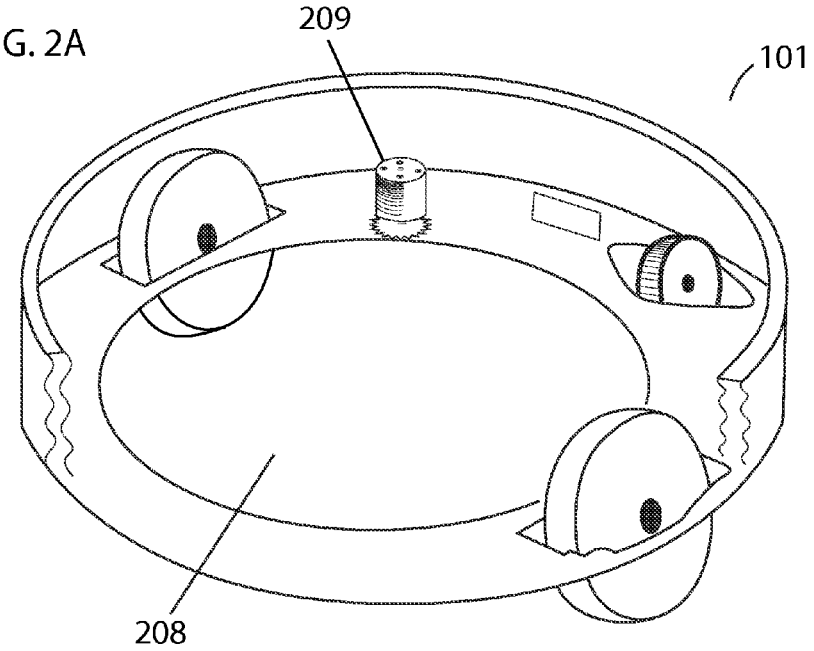
FIG. 2A illustrates a cutaway of a perspective view of the outer section of a robotic vacuum embodying features of the present invention.
Figure 2B:
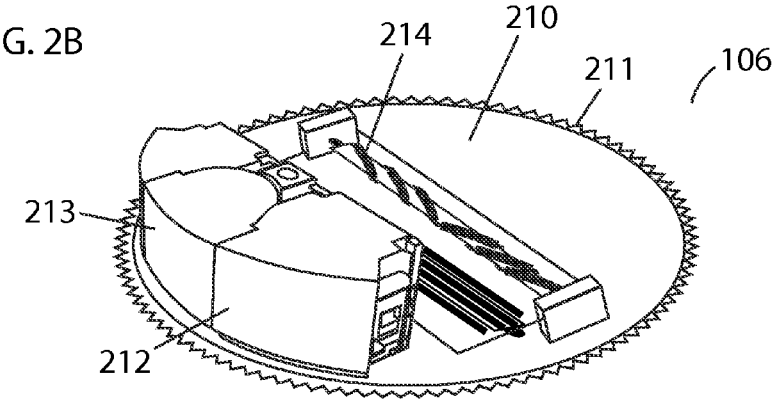
FIG. 2B illustrates a perspective view of the inner section of a robotic vacuum embodying features of the present invention.

Referring to FIG. 2A, a cutaway of a perspective view of the outer section 101 of the robotic vacuum is illustrated. The opening 208 is where the inner section, depicted in FIG. 2B, is installed. An electric motor and set of gears 209 rotate the inner section.

Referring to FIG. 2B, a perspective view of the inner section 106 of the robotic vacuum is illustrated. The inner section comprises a plate 210 with a serrated edge 211 that engages with the gear set in FIG. 2A to rotate the inner section. The debris container 212, vacuum motor 213, and cleaning apparatus 214 are installed on the inner section.

In the preferred embodiment, as the robotic vacuum drives through an area, the motor and gear set rotate the plate of the inner section so that the cleaning apparatus rotates in a plane horizontal to the work surface. In the preferred embodiment, the rate of rotation of the inner section in relation to the driving speed of the wheels is fast enough the cleaning apparatuses are caused to pass over substantially the same area two or more times before the robotic vacuum drives out of that area.

We claim:

1. A method for cleaning a working surface with a robotic vacuum comprising:

providing a robotic vacuum having an inner section and an outer section, wherein said inner section is rotatable inside of said outer section;

providing an electric motor and gear set on said outer section to rotate said inner section;

providing one or more cleaning apparatuses of said robotic vacuum on said inner section;

providing on said inner section a plate with a serrated edge interlocking with said gear set to rotate said inner section; and rotating said inner section and said one or more cleaning apparatuses in a plane parallel to a plane of a working surface during operation of said robotic vacuum, such that said one or more cleaning apparatuses are caused to rotate over and clean said work surface as said robotic vacuum drives over said work surface.

2. The method of claim 1, wherein rotating said inner section in relation to a driving speed of the robotic vacuum is fast enough that said one or more cleaning apparatuses are caused to pass over said work surface two or more times before the robotic vacuum drives away from said work surface.

3. The method of claim 1 wherein said one or more cleaning apparatuses comprise a rotatable brush.

* * * * *